US008303469B2

(12) United States Patent
Alexander

(10) Patent No.: US 8,303,469 B2
(45) Date of Patent: Nov. 6, 2012

(54) TRAMPOLINE

(75) Inventor: Keith Vivian Alexander, Christchurch (NZ)

(73) Assignee: Board & Batten International Inc., Georgetown (KY)

( * ) Notice: Subject to any disclaimer, the term of this patent is extended or adjusted under 35 U.S.C. 154(b) by 249 days.

(21) Appl. No.: 12/741,481

(22) PCT Filed: Nov. 3, 2008

(86) PCT No.: PCT/NZ2008/000292

§ 371 (c)(1),
(2), (4) Date: Aug. 30, 2010

(87) PCT Pub. No.: WO2009/061217

PCT Pub. Date: May 14, 2009

(65) Prior Publication Data

US 2010/0317490 A1 Dec. 16, 2010

(30) Foreign Application Priority Data

Nov. 5, 2007 (NZ) ..... 563175

(51) Int. Cl.
*A63B 5/11* (2006.01)

(52) U.S. Cl. ..... 482/27

(58) Field of Classification Search ..... 482/23, 482/26–29, 77, 121–130; *A63B 5/11*
See application file for complete search history.

(56) References Cited

U.S. PATENT DOCUMENTS

| | | | | |
|---|---|---|---|---|
| 3,767,009 | A * | 10/1973 | Sidlinger | 482/27 |
| 6,319,174 | B1 | 11/2001 | Alexander | |
| 2004/0171461 | A1 | 9/2004 | Alexander | |
| 2004/0171462 | A1* | 9/2004 | Alexander | 482/27 |
| 2006/0025283 | A1 | 2/2006 | Chen | |

FOREIGN PATENT DOCUMENTS

WO 2004/062739 7/2004

OTHER PUBLICATIONS

International Search report dated May 13, 2009 of International Application No. PCT/NZ2008/000292.
International Preliminary Report on Patentability dated May 11, 2010 of International Application No. PCT/NZ2008/000292.

* cited by examiner

*Primary Examiner* — Oren Ginsberg
(74) *Attorney, Agent, or Firm* — Dann, Dorfman, Herrell and Skillman, P.C.

(57) ABSTRACT

A trampoline comprises a flexible mat, a plurality of resiliently flexible rods each having an upper end retained in the flexible mat, and a base frame arranged to retain the lower ends of the flexible rods. The base frame comprises for each rod an aperture through an upper side of the base frame into the interior of the tubular frame, and a formation into the interior of the tubular base frame from the lower side of the base frame and spaced laterally from the aperture, which may be formed by deforming material of the underside wall of the base frame into the interior of the base frame, for receiving the lower end of the flexible rod.

20 Claims, 2 Drawing Sheets

TRAMPOLINE

FIELD OF INVENTION

The invention relates to a frame structure for a trampoline for sporting and/or recreational use which is soft-edged relative to conventional trampolines.

BACKGROUND

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

PCT patent application publication WO2004/062739 discloses such a soft-edged trampoline in which the base frame of the trampoline comprises multiple tubular holders, one for receiving the lower end of each flexible rod which supports the mat of the trampoline.

SUMMARY OF INVENTION

The invention provides an improved or at least alternative frame structure for a soft-edged trampoline.

In broad terms one aspect the invention comprises a trampoline comprising:

- a flexible mat;
- a plurality of resiliently flexible rods each having an upper end retained in the flexible mat; and
- a base frame arranged to retain the lower ends of the flexible rods, the base frame comprising for each rod an aperture through an upper side of the base frame into the interior of the tubular frame, and a formation into the interior of the tubular base frame from the lower side of the base frame and spaced laterally from the aperture, for receiving the lower end of the flexible rod.

In broad terms a further aspect the invention comprises a trampoline comprising a tubular base frame arranged to retain the lower ends of resiliently flexible rods, the base frame comprising for each rod an aperture through an upper side of the base frame into the interior of the tubular frame, and a formation into the interior of the tubular base frame from the lower side of the base frame and spaced laterally from the aperture, for receiving the lower end of the flexible rod.

Preferably the formation into the interior of the tubular base frame for each rod from the under side of the tubular base frame, is formed by deforming material of the underside wall of the base frame into the interior of the base frame.

Preferably the base frame is comprised of a plurality of interconnectable tubular base frame sections. Preferably adjacent base frame sections are connected by an extending tongue portion of one base frame section engaging into a recess in an adjacent frame base section.

In this specification (including claims) the term "trampoline" is intended to extend also to smaller trampolines commonly referred to as rebounders as well as larger trampolines of all sizes.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

BRIEF DESCRIPTION OF THE DRAWINGS

A preferred form of the frame structure for a trampoline is described with reference to the accompanying drawings by way of example and without intending to be limiting, wherein.

DETAILED DESCRIPTION OF PREFERRED FORM

Figure 1:
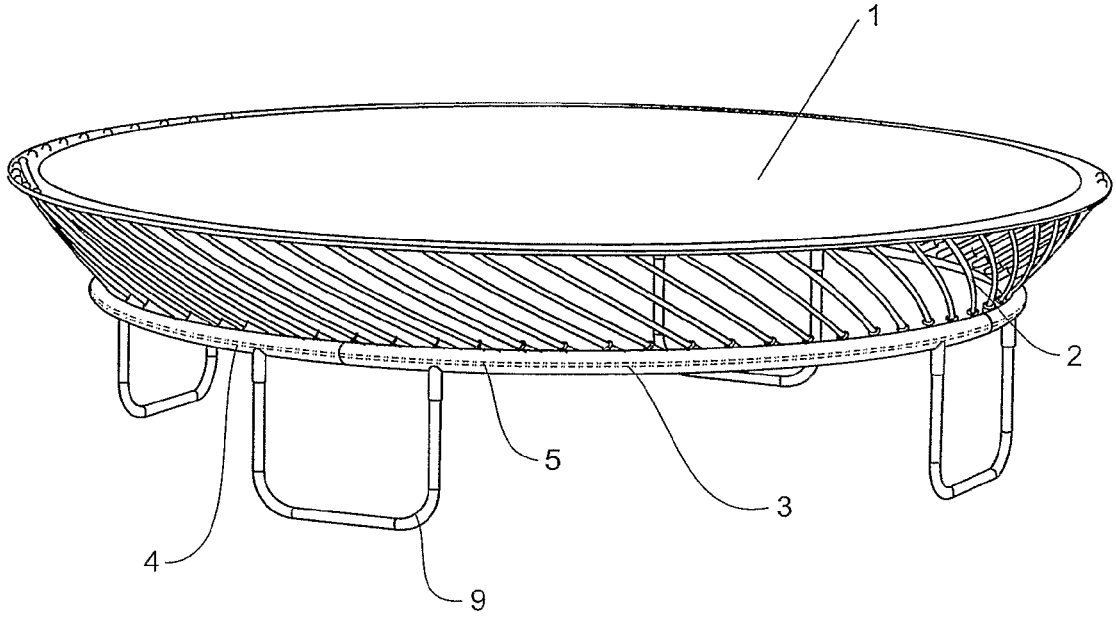
FIG. 1 is a perspective view of one preferred form trampoline.

Referring to FIG. 1, the preferred form of trampoline comprises a flexible mat 1 on which users may bounce, a plurality of resiliently flexible rods 2, and an annular base frame 3. The preferred form trampoline is circular in shape but may be any other desired shape, such as oval, square, rectangular or similar.

In the preferred form the base frame 3 comprises a number of interconnected sections. In another form, the base frame 3 could comprise a one part ring, although this is less preferred. The base frame or each base section is preferably formed from metal such as steel, aluminium or other suitable material.

Figure 2:
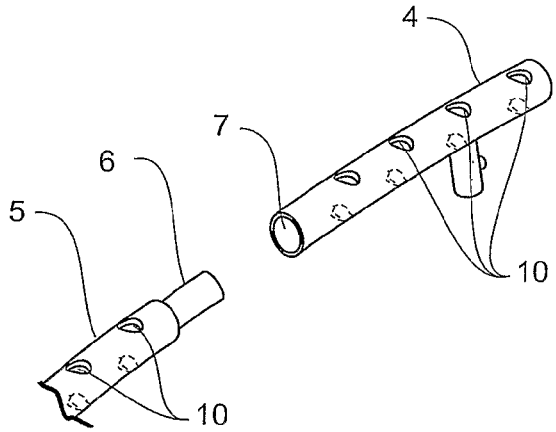
FIG. 2 is an enlarged view showing the connection of two of the adjacent base sections of the trampoline of FIG. 1.

FIG. 2 shows a connection between two base frame sections 4 and 5. Each section is provided with a tongue portion 6 at one end. Each base section also comprises a recess 7 at its other end into which the extending tongue portion 6 of an adjacent base section engages.

Rods 2 are typically fibreglass rods but may alternatively be formed of spring steel, for example. The lower ends of the rods are retained in the tubular base frame 3 and the upper ends of the rods are each retained in the flexible mat 1 in a suitable fitting.

The base frame 3 can be positioned on the ground or other surface. Preferably however the trampoline includes legs 9, the upper ends of which are fixed to the base frame 3.

Figure 3:
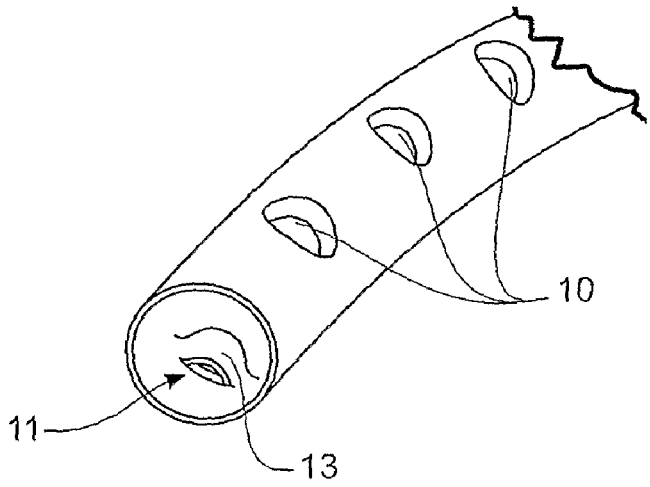
FIG. 3 is a view of one end of a base section of the trampoline.
Figure 4:
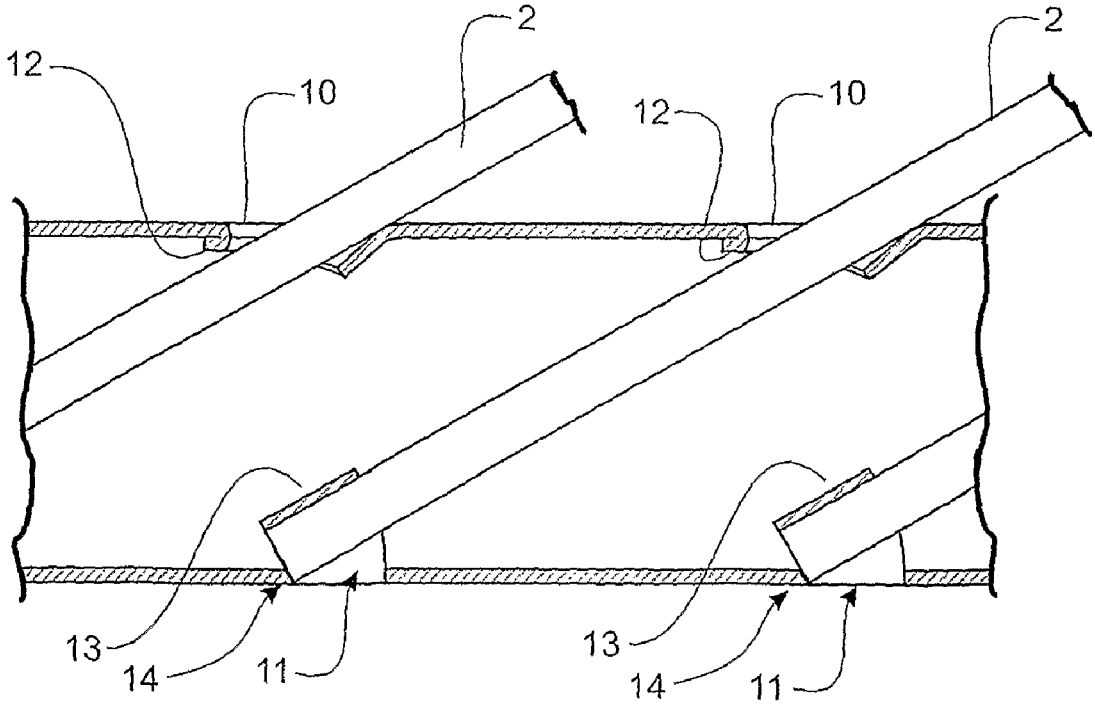
FIG. 4 is a cross-section view through a base section of the trampoline.

The base frame 3 retains the lower ends of the rods 2. Referring particularly to FIGS. 3 and 4, the base frame 3 comprises for each rod an aperture 10 through an upper side of the base frame into the interior of the tubular frame, and a formation generally indicated at 11, into the interior of the tubular base frame from the lower side of the base frame and spaced laterally from the aperture, for receiving the lower end of the flexible rod. In the preferred form shown the edge of each aperture 10 is rolled into the interior of the base frame as indicated at 12, to avoid an aperture edge wearing against or cutting the rod 2 which it holds.

The formation 11 from the lower side of the base frame is formed by deforming material of the underside wall of the base frame into the interior of the base frame as shown. A strip 13 of material so formed is pushed inwardly, and to one side. When the rod end is inserted into the rod holder thus formed, the end of the rod 2 abuts the internal wall edge 14 of the tubular base frame, and is held in position by the deformed strip 13 wrapping around the side of the end of the rod.

Preferably the aperture 10 and tolled edge 12, and deformation 11 are formed by punching into the base frame from either side during manufacture.

The foregoing describes the invention including preferred forms thereof. Alterations and modifications as will be obvious to those skilled in the art are intended to be incorporated within the scope hereof as defined in the accompanying claims.

The invention claimed is:

1. A trampoline comprising:

a flexible mat;

a plurality of resiliently flexible rods each having an upper end retained in the flexible mat; and a base frame arranged to retain lower ends of the flexible rods, the base frame comprising for each rod an aperture through an upper side of the base frame into an interior of the base frame, and a formation into the interior of the base frame from an underside wall of the base frame and spaced laterally from the aperture, for receiving the lower end of the flexible rod, the information into the interior of the base frame for each rod from the underside of the base frame comprises a section of material of the underside wall of the base frame deformed into the interior of the base frame.

2. A trampoline according to claim 1 wherein said section of material of the underside wall of the base frame deformed into the interior of the base frame comprises a strip of material of the underside wall of the base frame deformed into the interior of the base frame and to one side such that when a said rod is inserted into a rod holder thus formed, the lower end of the rod abuts an internal wall edge of the base frame and is held in position by the deformed strip wrapping around the side of the lower end of the rod.

3. A trampoline according to claim 2 wherein the edge of each said aperture through an upper side of the base frame is rolled into the interior of the base frame to avoid an aperture edge wearing against or cutting the rod which it holds.

4. A trampoline according to claim 3 wherein the base frame is formed of metal and said aperture and formation have been formed by punching into the base frame from either side during manufacture.

5. A trampoline according to claim 3 wherein the base frame is formed of metal and said aperture and formation have been formed by punching into the base frame from either side during manufacture.

6. A trampoline according to claim 1 wherein the edge of each said aperture through an upper side of the base frame is rolled into the interior of the base frame to avoid an aperture edge wearing against or cutting the rod which it holds.

7. A trampoline according to claim 6 wherein the base frame is formed of metal and said aperture and formation have been formed by punching into the base frame from either side during manufacture.

8. A trampoline according to claim 1 wherein the base frame is formed of metal and said aperture and formation have been formed by punching into the base frame from either side during manufacture.

9. A trampoline according to claim 1 wherein the base frame is comprised of a plurality of interconnectable base frame sections.

10. A trampoline according to claim 9 wherein adjacent base frame sections are connected by an extending tongue portion of one base frame section engaging into a recess in an adjacent frame base section.

11. A trampoline according to claim 1 wherein said rods are fibreglass rods.

12. A trampoline according to claim 1 wherein the edge of each said aperture through an upper side of the base frame is rolled into the interior of the base frame to avoid an aperture edge wearing against or cutting the rod which it holds.

13. A trampoline according to claim 12 wherein the base frame is formed of metal and said aperture and formation have been formed by punching into the base frame from either side during manufacture.

14. A trampoline according to claim 1 wherein the base frame is formed of metal and said aperture and formation have been formed by punching into the base frame from either side during manufacture.

15. A trampoline comprising:

a flexible mat;

a plurality of resiliently flexible rods each having an upper end retained in the flexible mat; and a base frame arranged to retain lower ends of the flexible rods, the base frame comprising for each rod an aperture through an upper side of the base frame into an interior of the base frame, and a section of material of an underside wall of the base frame spaced laterally from the aperture deformed into the interior of the base frame such that when a lower end of a said flexible rod is inserted into a rod holder thus formed, the lower end of the rod abuts the internal wall edge of the base frame and is held in position by the deformed section of material wrapping around the side of the lower end of the rod.

16. A trampoline according to claim 15 wherein the edge of each said aperture is rolled into the interior of the base frame to avoid an aperture edge wearing against or cutting the rod which it holds.

17. A trampoline according to claim 15 wherein the base frame is formed of metal and said aperture and deformed section of material of the underside wall of the base frame have been formed by punching into the base frame from either side during manufacture.

18. A trampoline comprising:

a flexible mat;

a plurality of resiliently flexible rods each having an upper end retained in the flexible mat; and a base frame arranged to retain lower ends of the flexible rods, the base frame comprising for each rod an aperture through an upper side of the base frame into an interior of the base frame, and a strip of material of an underside wall of the base frame spaced laterally from the aperture deformed into the interior of the base frame such that when the lower end of a said flexible rod is inserted into a rod holder thus formed, the lower end of the rod abuts the internal wall edge of the base frame and is held in position by the deformed strip wrapping around the side of the lower end of the rod.

19. A trampoline according to claim 18 wherein the edge of each said aperture is rolled into the interior of the base frame to avoid an aperture edge wearing against or cutting the rod which it holds.

20. A trampoline according to claim 18 or claim 19 wherein the base frame is formed of metal and said aperture and deformed strip of material from the underside wall of the base frame have been formed by punching into the base frame from either side during manufacture.

* * * * *